US006442365B1

(12) United States Patent
Schlueter, Jr. et al.

(10) Patent No.: US 6,442,365 B1
(45) Date of Patent: Aug. 27, 2002

(54) THERMALLY CONDUCTIVE FUSER BELT

(75) Inventors: Edward L. Schlueter, Jr., Rochester; Joseph Mammino, Penfield; Edward F. Bowler, Jr., Fairport, all of NY (US)

(73) Assignee: Xerox Corporation, Stamford, CT (US)

( * ) Notice: Subject to any disclaimer, the term of this patent is extended or adjusted under 35 U.S.C. 154(b) by 326 days.

(21) Appl. No.: 09/056,945

(22) Filed: Apr. 8, 1998

(51) Int. Cl.[7] ..... G03G 15/20
(52) U.S. Cl. ..... 399/328
(58) Field of Search ..... 399/328, 329, 399/330

(56) References Cited

U.S. PATENT DOCUMENTS

| | | | | |
|---|---|---|---|---|
| 3,584,195 A | | 6/1971 | Vince | 219/388 |
| 4,763,158 A | | 8/1988 | Schlueter, Jr. | 355/3 FU |
| 5,103,263 A | | 4/1992 | Moore et al. | 355/212 |
| 5,268,559 A | | 12/1993 | Jacobs | 219/216 |
| 5,345,300 A | | 9/1994 | Uehara et al. | 355/285 |
| 5,450,182 A | * | 9/1995 | Waymon et al. | 399/328 |
| 5,465,146 A | * | 11/1995 | Higoshi et al. | 399/328 |
| 5,483,331 A | * | 1/1996 | Wayman et al. | 399/330 |
| 5,674,621 A | | 10/1997 | Visser et al. | 428/408 |

OTHER PUBLICATIONS

A brochure (10 pages) describing various SIL–PAD® products from Bergquist Company Jul. 25, 1995.
Clifford O. Eddy, U.S. patent application Ser. No. 08/572,212, titled "Thin, Thermally Conductive Fluoroelastomer Coated Fuser Member".
Robert N. Finsterwalder et al., U.S. patent application Ser. No. 08/050,135, titled "Fabric Fuser Film".

* cited by examiner

*Primary Examiner*—Fred L Braun
(74) *Attorney, Agent, or Firm*—Zosan Soong

(57) ABSTRACT

A fuser belt that is used in an electrostatographic printing machine. The fuser belt has a thickness ranging from about 3 to about 20 mils and has a substrate layer and a toner release layer. The substrate layer is composed of a base material and a first thermally conductive additive, wherein the base material is composed of fibers or a polymeric film. The toner release layer is composed of an elastomeric material and a second thermally conductive additive.

9 Claims, 3 Drawing Sheets

THERMALLY CONDUCTIVE FUSER BELT

FIELD OF THE INVENTION

The present invention relates to a fuser belt and a fusing system for fusing toner images in electrostatographic printing machines.

BACKGROUND OF THE INVENTION

In electrostatographic printing machines commonly used today, a charge retentive surface is typically charged to a uniform potential and thereafter exposed to a light source to thereby selectively discharge the charge retentive surface to form a latent electrostatic image thereon. The image may be either the discharged portions or the charged portions of the charge retentive surface. The light source may be any well known device such as a light lens scanning system or a laser beam. Subsequently, the electrostatic latent image on the charge retentive surface is rendered visible by developing the image with developer powder referred to in the art as toner. The visible toner image is then in a loose powdered form and can be easily disturbed or destroyed. The toner image is usually fixed or fused upon a support which may be a photosensitive member itself or other support sheet such as plain paper.

The use of thermal energy for fixing toner images onto a support member is well known. In order to fuse toner onto a support surface permanently by heat, it is necessary to elevate the temperature of the toner to a point at which the constituents of the toner coalesce and become tacky. This heating causes the toner to flow to some extent into the fibers or pores of the support member. Thereafter, as the toner cools, solidification of the toner causes it to be firmly bonded to the support Typically, toner particles are fused to the support by heating to a temperature of between about 90° C. to about 160° C. or higher depending upon the softening range of the particular resin used in the toner. It is generally undesirable, however, to raise the temperature of the support substantially higher than about 200° C. because of the tendency of the support to discolor at such elevated temperatures particularly when the support is paper.

Several approaches to thermal fusing of toner images have been described in the prior art. These methods include providing the application of heat and pressure substantially concurrently by various means: a roll pair maintained in pressure contact; a belt member in pressure contact with a roll; and the like. Heat may be applied by heating one or both of the rolls, plate members or belt members. The fusing of the toner particles takes place when the proper combination of heat, pressure and contact time are provided. The balancing of these parameters to bring about the fusing of the toner particles is well known in the art, and they can be adjusted to suit particular machines or process conditions.

One of the problems with conventional fuser systems is supplying heat for fusing at higher speeds. For example, color xerographic machines require at least four color toner piles to be fixed to the paper at a speed of at least about 20 inches per second. With increased speed and toner/ink pile height, more heat is required to maintain a fixing temperature to assure that the toner is permanently attached to the paper. With certain conventional fuser systems at higher speeds, the core temperature needs to be increased to more than 500° F. to maintain the proper surface temperatures for the fusing event. Higher fusing temperatures are undesirable because of power contraints, heat management issues and material limitations. It requires excessive power requirements to achieve higher temperatures, more stringent non-flammable material properties for the fuser elements as well as other components located near the fuser, greater efforts to dissipate heat to prevent overheating of the photoreceptor, toner, and other critical machine parts. Thus, there is a need, which the present invention addresses, for a fuser member and fuser system that reduces the temperature needed to achieve satisfactory fusing.

Conventional fusing members and fusing systems are disclosed in Uehara et al., U.S. Pat. No. 5,345,300; Jacobs, U.S. Pat. No. 5,268,559; Visser et al., U.S. Pat. No. 5,674,621; Schlueter, Jr., U.S. Pat. No. 4,763,158; Vince, U.S. Pat. No. 3,584,195; and Moore et al., U.S. Pat. No. 5,103,263.

In addition, the following document may be relevant: a brochure (10 pages) describing various SIL-PAD® products.

SUMMARY OF THE INVENTION

The present invention is accomplished in embodiments by providing a fuser member for use in an electrostatographic printing machine, comprising:

(a) a substrate layer including a base material and a first thermally conductive additive, wherein the substrate layer is other than a solid layer of a metal or metal alloy; and (b) an outer toner release layer including an elastomeric material and a second thermally conductive additive, wherein the fuser member is an endless belt that has a thickness ranging from about 3 to about 20 mils.

BRIEF DESCRIPTION OF THE DRAWINGS

Other aspects of the present invention will become apparent as the following description proceeds and upon reference to the Figures which represent preferred embodiments.

DETAILED DESCRIPTION

Figure 1:
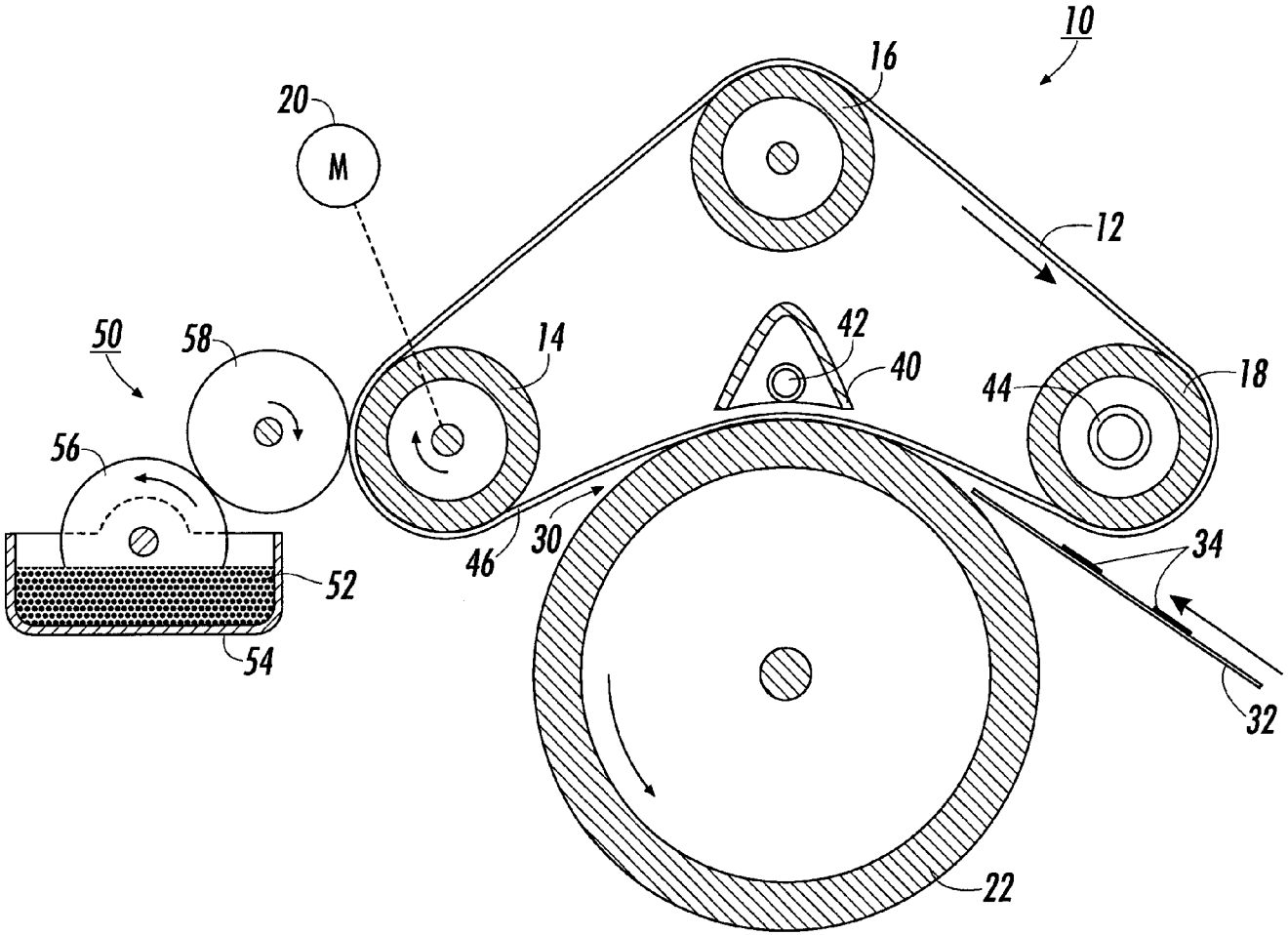
FIG. 1 is a simplified, side elevational view of a fuser system according to the present invention.

The present fuser member (also referred herein as fuser belt) is an endless belt, preferably flexible, which can be seamed or seamless. The fuser belt is thin having a thickness ranging for example from about 3 to about 20 mils, preferably from 5 to about 15 mils.

The substrate layer is other than a solid layer of a metal or metal alloy. Thus, a substrate layer wholly fabricated from nickel, stainless steel, aluminum, or aluminum alloy is disfavored for use as the substrate layer. The harder thermally conductive substrates lack the conformability and flex life of the polymeric film or fabric substrates. However, the base material can be a polymeric film having a metal layer, with a thermally conductive additive incorporated into the polymeric film. The base layer has a thickness ranging for example from about 1 to about 5 mils, preferably from about 2 to about 4 mils.

In preferred embodiments, the base material of the substrate layer exhibits the following: withstands without significant degradation in its physical properties a high operating temperature (e.g., greater than about 180, preferably greater than about 200° C. and more specifically, from about 200 to about 350° C.), high mechanical strength, heat conducting properties (this, in turn, improves the thermal efficiency of a fusing system employing the fuser belt), and optionally tailored electrical properties.

As the base material, a polymer such as a polyimide can be used. A polyimide having a high tensile modulus is preferred primarily because the high tensile modulus optimizes the film stretch registration and transfer or fix conformance. The polyimide has the advantages of improved flex life and image registration, chemical stability to liquid developer or toner additives, thermal stability for transfix applications and relative ease of applying overcoatings to a polyimide substrate, improved solvent resistance as compared to known materials used for film for electrostatographic components, and improved electrical properties including a uniform resistivity within the desired range. Suitable polyimides include those formed from various diamines and dianhydrides, such as poly(amide-imide), polyetherimide, siloxane polyetherimide block copolymer such as, for example, SILTEM STM-1300® available from General Electric, Pittsfield, Mass., and the like. Preferred polyimides include aromatic polyimides such as those formed by reacting pyromellitic acid and diaminodiphenylether sold under the tradename KAPTON®-type-HN available from DuPont. Another suitable polyimide available from DuPont and sold as KAPTON®-Type-FPC-E, is produced by imidization of copolymeric acids such as biphenyltetracarboxylic acid and pyromellitic acid with two aromatic diamines such as p-phenylenediamine and diaminodiphenylether. Another suitable polyimide includes pyromerfitic dianhydride and benzophenone tetracarboxylic dianhydride copolymeric acids reacted with 2,2-bis(4-(8-aminophenoxy) phenoxy)-hexafluoropropane available as EYMYD® type L-20N from Ethyl Corporation, Baton Rouge, La. Other suitable aromatic polyimides include those containing 1,2,1',2'-biphenyltetracarboximide and paraphenylene groups such as UPILEX®-S available from Uniglobe Kisco, Inc., White Plains, N.Y., and those having biphenyltetracarboximide functionality with diphenylether end spacer characterizations such as UPILEX®-R also available from Uniglobe Kisco, Inc. Mixtures of polyimides also can be used. A preferred base material is the thermally conductive KAPTON® MT polyimide films.

Other suitable base materials include for example polyamide made by polycondensation from terephthalic acid and an alkyl-substituted hexamethylene diamine such as TROGAMID-T™ available from Dynamit Nobel, Germany, and various aromatic polyamide polymers available from DuPont under the NOMEX™ and KELVAR™ tradenames, polyphenylene sulfide such as FORTRON™ available from Hoechst Celanese and also Aromatic Liquid Crystal Poylester polymers such as VECTRA™ sold by Hoechst Celanese. In embodiments, the base material can be composed of a plurality of fibers such as fiberglass which may be in the form of a fabric. Thus, the base material can be in the form of either a film or a fabric.

Fabric, as used herein, refers to a textile structure composed of mechanically interlocked fibers or filaments, which may be woven or nonwoven. Fabrics are materials made from fibers or threads and woven, knitted or pressed into a cloth or felt type structures. Woven, as used herein, refers to closely oriented by warp and filler strands at right angles to each other. Nonwoven, as used herein, refers to randomly integrated fibers or filaments. It is preferred that the fabric substrate has a flexural strength of from about 2,000,000 to about 3,000,000 psi, and a flexural modulus of from about 25,000 to about 55,000 psi. Examples of suitable fabrics include woven or nonwoven cotton fabric, graphite fabric, fiberglass, woven or nonwoven polyimide, such as those commercially available as NOMEX™ (polyphenylene isophthalamide).

Preferably, the outer toner release layer (also referred herein as "outer layer") is composed of low surface energy (e.g., from about 20 to about 30 dynes/cm), and high temperature resistant elastomeric materials. Preferably, the outer layer has the ability to absorb only a surface monolayer of toner release oil, i.e., functionalized or regular dimethylsiloxane oil or fluid. It is not desirable to have any substantial amount of oil absorbed by the toner release layer (preferably less than about 5% by volume of oil/fluid on the outer layer). The outer layer needs to be elastic and thick enough so that the toner conforms to paper or substrate during the fusing event. This is a modulus ranging for example from approximately 100 to about 2,000 psi with a preferred range of about 300 to about 1,500 psi. In embodiments, the thickness of the outer toner release layer may be about 0.5 mils to about 5 mil depending on the substrate being used. The surface of the fuser member generally needs a high enough gloss as to enable high quality images without noticeable gloss variations. This is typically about 60 to about 90 gloss units with a perferred range about 75 to about 85. The outer layer is the outermost layer of the fuser belt and thus there is no layer over the outer layer. The release agent which is used in certain fusing systems to cover the outer layer during fusing fails to constitute a layer in the sense of the outer layer and the substrate layer since the release agent is not permanently bonded to the outer layer.

Preferred materials for the outer layer include fluoroelastomers such as copolymers and terpolymers of vinylidenefluoride, hexafluoropropylene and tetrafluoroethylene, which are known commercially under various designations as VITON A®, VITON E®, VITON E60C®, VITON E45®, VITON E430®, VITON 910®, VITON GH®, VITON B50®, and VITON GF®. The VITON® designation is a Trademark of E. I. DuPont de Nemours, Inc. Other commercially available materials include FLUOREL 2170®, FLUOREL 2174®, FLUOREL 2176®, FLUOREL 2177® and FLUOREL LVS 76® FLUOREL® being a Trademark of 3M Company. Additional commercially available materials include AFLAS™ a poly(propylene-tetrafluoroethylene) and FLUOREL II® (LII900) a poly(propylene-tetrafluoroethylenevinylidenefluoride) both also available from 3M Company, as well as the Tecnoflons identified as FOR60KIR®, FOR-LHF®, NM® FOR-THF®, FOR-TFS®, TH®, TN505® available from Montedison Specialty Chemical Company.

Two preferred fluoroelastomers are: (1) a class of copolymers of vinylidenefluoride, tetrafluoroethylene and hexafluoropropylene known commercially as VITON A®; and (2) a class of terpolymers of vinylidenefluoride, hexafluoropropylene, and tetrafluoroethylene known commercially as VITON B®.

In another preferred embodiment, the fluoroelastomer is a tetrapolymer having a relatively low quantity of vinylidenefluoride. An example is VITON GF®, available from E. I. DuPont de Nemours, Inc. The VITON GF® has 35 mole percent of vinylidenefluoride, 34 mole percent of hexafluoropropylene and 29 mole percent of tetrafluoroethylene with 2 percent cure site monomer. The cure site monomer can be those available from DuPont such as 4-bromoperfluorobutene-1, 1,1-dihydro- 4bromoperfluorobutene- 1, 3-bromoperfluoropropene- 1, 1,1-dihydro-3-bromoperfluoropropene-1, or any other suitable, known, commercially available cure site monomer.

In another embodiment of the invention, the fluoroelastomer is a volume grafted elastomer. Volume grafted elastomers are a special form of hydrofluoroelastomer and are substantially uniform integral interpenetrating networks of a hybrid composition of a fluoroelastomer and a polyorganosiloxane, the volume graft having been formed by dehydrofluorination of fluoroelastomer by a nucleophilic dehydrofluorinating agent, followed by addition polymerization by the addition of an alkene or alkyne functionally terminated polyorganosiloxane and a polymerization initiator. A volume grafted elastomer, in embodiments, refers to a substantially uniform integral interpenetrating network of a hybrid composition, wherein both the structure and the composition of the fluoroelastomer and polyorganosiloxane are substantially uniform when taken through different slices of the member. Examples of specific volume graft elastomers are disclosed in U.S. Pat. Nos. 5,166,031; 5,281,506; 5,366,772; and 5,370,931, the disclosures of which are herein incorporated by reference in their entirety.

Other preferred polymers useful as the outer layer include silicone rubbers and preferably silicone rubbers having molecular weights of from about 600 to about 4,000, such as silicone rubber 552, available from Sampson Coatings, Richmond, Va. (polydimethyl siloxane/dibutyl tin diacetate, 0.45 g DBTDA (dibutyl tin diacetate) per 100 grams polydimethyl siloxane rubber mixture, with molecular weight of approximately 3,500). Additional polymers useful as the outer layer include fluorosilicones. Fluoropolymers such as polytetrafluoroethylene (PTFE), fluorinated ethylenepropylene copolymer (FEP), polyfluoroalkoxypolytetrafluoroethylene (PFA Teflon) and the like, which are not generally considered elastomers may be included as particulate fillers in the elastomer.

The outer layer has a thickness ranging for example from about 0.5 to about 5 mils, preferably from about 3 to about 5 mils. In embodiments, the outer layer has a conformity resulting from a thickness of at least about 3 mils, preferably from about 3 mils to about 5 mils, and a hardness ranging from about 45 to about 70 Shore A.

The first and second thermally conductive additives can be the same or different additive. Suitable thermally conductive additives include for example particles of boron nitride, aluminum oxide, carbon black, aluminum nitride, zinc oxide, and metal powders such as stainless steel and nickel. The first and second thermally conductive additives such as some of the metal powders also can be electrically conductive and/or magnetic. The thermally conductive additive can be particles dispersed through the base material and the elastomeric material The first and second thermally conductive additives can have a particle size ranging from about 0.01 micron to about 15 microns. In embodiments, the substrate layer can be a fabric (i.e., the base material) coated with a composition containing a binder (e.g., an adhesive, or a liquid polymer material that is coated on the fibers and then crosslinked) and the thermally conductive additive. In embodiments where the base material is composed of a plurality of fibers, the individual fibers can be coated with a layer of a binder and the thermally conductive additive or fabricated from a fiber forming composition containing the thermally conductive additive such that the thermally conductive additive is part of the fibers instead of in a coating. The substrate layer can contain the same or different amount of the thermally conductive additive than the outer layer. The first thermally conductive additive may be present in the substrate layer in an amount ranging for example from about 10 to about 50% by weight, preferably from about 20 to about 40% by weight, of the substrate layer. The second thermally conductive additive may be present in the outer layer in an amount ranging for example from about 10 to about 50% by weight, preferably from about 20 to about 40% by weight, of the outer layer.

The substrate layer and the outer layer may include other additives or agents as long as they do not adversely affect the integrity of these layers. Such agents may include coloring agents, processing aids, accelerators, and polymerization initiators. In embodiments, the substrate layer, the outer layer, or both optionally contains electrical property regulating particles which can be for example a doped metal oxide. Preferred doped metal oxides include antimony doped tin oxide, aluminum doped zinc oxide, similar doped metal oxides, and mixtures thereof. Examples of other suitable electrical property regulating particles are carbon black and graphite; metal oxides such as tin oxide, antimony dioxide, titanium dioxide, indium oxide, zinc oxide, indium oxide, indium tin trioxide, and the like; and mixtures thereof. The total amount of the electrical property regulating particles in each layer may range from about 1 to about 30% by weight of the layer.

An adhesive layer may be positioned between the substrate layer and the outer layer. Examples of suitable adhesives include Dow Corning A4040® prime coat, which is especially effective when used with fluorosilicone layers, and Dow TACTIX® blends, Ciba-Geigy ARALDITE® MY-721 and Morton THIXON® 330/311, all of which are suitable for use with fluoropolymer and silicone rubber layers. The adhesive layer may have a thickness ranging from about 1 to about 3 mils.

An intermediate layer composed of for example of the same or different elastomeric material and the same or different thermally conductive additive used in the outer layer may be present between the outer layer and the substrate layer. The intermediate layer has a thickness ranging for example from about 1 to about 8 mils, preferably from about 1.5 to about 5 mils.

The fuser belt can be prepared by any suitable technique. For example, in a first technique, the base material is mixed with the thermally conductive additive (electrical property regulating particles also may be included). The resulting composition is then extruded using liquid extrusion and formed into a flat sheet and cured to form a high modulus material for the substrate layer. The outer layer can be applied using typical extrusion techniques such as reverse roil metering or Meyer bar coating. The layered material is then subjected to in line cure cycles to totally crosslink the extruded sheet and coating or coatings. This extruded sheet is formed into a belt and seamed utilizing conventional joining methods such as butt joining and overlapping. The seaming process can also utilize the puzzle cut seam and typical adhesives for attachment. High temperature adhesives such as epoxy, silicone, vinyl butyral and other flexible adhesives can be used. In a second belt fabrication technique, a seamless belt can be formed from the material formulations by spraying, dip coating, flow coating, or centrifugal casting.

The instant inventors have discovered that enhancing the thermal conductivity of a thin fuser belt can result in a drop in the temperature needed to satisfactorily fuse a toner image to a support. The present thermally conductive, thin fuser belt can accomplish the same or equivalent fusing of the toner image to the support sheet at a lower fusing temperature, up to about 40° F. lower in embodiments. A fusing system which can fuse at a lower fusing temperature is advantageous since it consumes less energy, does not dry out paper, hence less curl, better toner fix and coalescence for same dwell time. The lower temperatures also enable longer wear and fuser system life plus reduce power requirements for start up and running the fuser system. Unless otherwise indicated, the fusing temperature is measured just before the fusing nip near the paper path centerline. The presence of the first and the second thermally conductive additives in the fuser belt increases the thermal conductivity by for example at least about 2 times, preferably at least about 3 times, and more preferably from about 3 times to about 4 times, as compared with the same fuser belt devoid of the first and second thermally conductive additives. The present fuser belt can be used in both dry developer and liquid developer type electrostatographic printing machines.

Attention is now directed to the FIG. 1 wherein a heat and pressure fuser system including a release agent management system is schematically illustrated. As shown in the FIG. 1, the fuser system 10 comprises a heated fuser belt member 12. The fuser belt preferably has a relatively smooth surface. A suitable degree of smoothness ensures the desired image gloss for fusing spot on spot color images as opposed to spot next to spot images.

The belt member 12 is entrained about a plurality of rollers 14, 16 and 18 for movement in an endless path. To this end, a motor 20 and a drive mechanism (not shown) are provided for effecting movement of the belt in the clockwise direction as viewed in the FIG. 1.

A relatively rigid pressure roll 22 is supported for rotation through movement of the belt by virtue of the friction therebetween. The pressure roll and the belt member form a fusing nip 30 through which substrate 32 carrying relatively thick toner images represented by reference number 34 pass with the toner images contacting the smooth surface of the belt member.

A radiant heating arrangement comprising a reflector 40 and a quartz heating element 42 are provided for heating the belt in the nip. While the radiant quartz lamp is shown as being positioned adjacent the middle of the nip 30 it will be appreciated that it may assume other positions relative to the nip. Another heating member 44 disposed internally of the idler roller 18 serves to preheat the belt prior to its passing through the nip.

The pressure roll 22 is rotated by the belt member 12. The pressure roll resists movement by the belt member due to the friction therebetween. The roller 14 is overdriven by the motor 20 to cause the post-nip extent 46 of the belt member to ,1s elongate for effecting separation of the toner image carrying substrate from the belt. By overdriven is meant that the drive roller is driven faster than the friction between the fuser belt and the pressure roll which allows the belt to be driven without stretching of the post-nip extent 46 of the belt 12. A friction retard roll (not shown) could be utilized in conjunction with or in lieu of the pressure roll for effecting resistance to belt movement for causing belt stretching. The retard roll could be positioned in contact with the inner surface of the belt in an area adjacent the support roller 14.

A liquid release agent management (RAM) or delivery system 50 is provided for applying a release agent material such as silicone oil 52 contained in a sump 54. The silicone oil is applied to the surface of the fuser belt member 12 via a metering roll 56 and a donor roll 58, the former of which is partially submersed in the silicone oil and contacts the latter for delivering silicone oil thereto. A thin film of the release agent on the fuser belt ensures that the toner image is completely released from the fuser belt during the fusing operation, thereby preventing the offset phenomenon.

The liquid release agent may be selected from those materials which have been conventionally used. Typical release agents include a variety of conventionally used silicone oils including both functional and non-functional oils. Thus, the release agent is selected to be compatible with the rest of the system.

The invention will now be described in detail with respect to specific preferred embodiments thereof, it being understood that these examples are intended to be illustrative only and the invention is not intended to be limited to the materials, conditions, or process parameters recited herein. All percentages and parts are by weight unless otherwise indicated.

EXAMPLES

Five belts were prepared as follows, where these five belts represented varying levels of thermal conductivity ("k") and X is 0.0012 calorie/cm-sec., where X represents the ratio of the thermal conductivity of the new material over the standard material which is an unfilled silicone rubber. In these examples, the toner mass per unit area is 0.9 to 1.0 mg/cm$^2$.

(1) 6 mil thick silicone/boron nitride belt (represented k equaling about 3.5 greater than X, i.e., about 3.5×): the belt had boron nitride filled silicone rubber coated on both sides of a thermally conductive polyimide sheet—1.5 mils thick (Kapton) core.

(2) 8 mil thick Viton B belt (represented k equaling 1×): polyester reinforced carbon black Viton B.

(3) 12 mil thick Gore belt (represented k equaling 1.5×): carbon black filled silicone rubber.

(4) 18 mil thick Viton belt (represented k equaling 2.5×): a high thermal conductivity composition containing Viton and thermally conductive particles.

(5) 5 mil thick Viton belt (represented k equaling 2.5×): a high thermal conductivity sprayed belt was made of Viton GF and thermally conductive particles.

Figure 2:
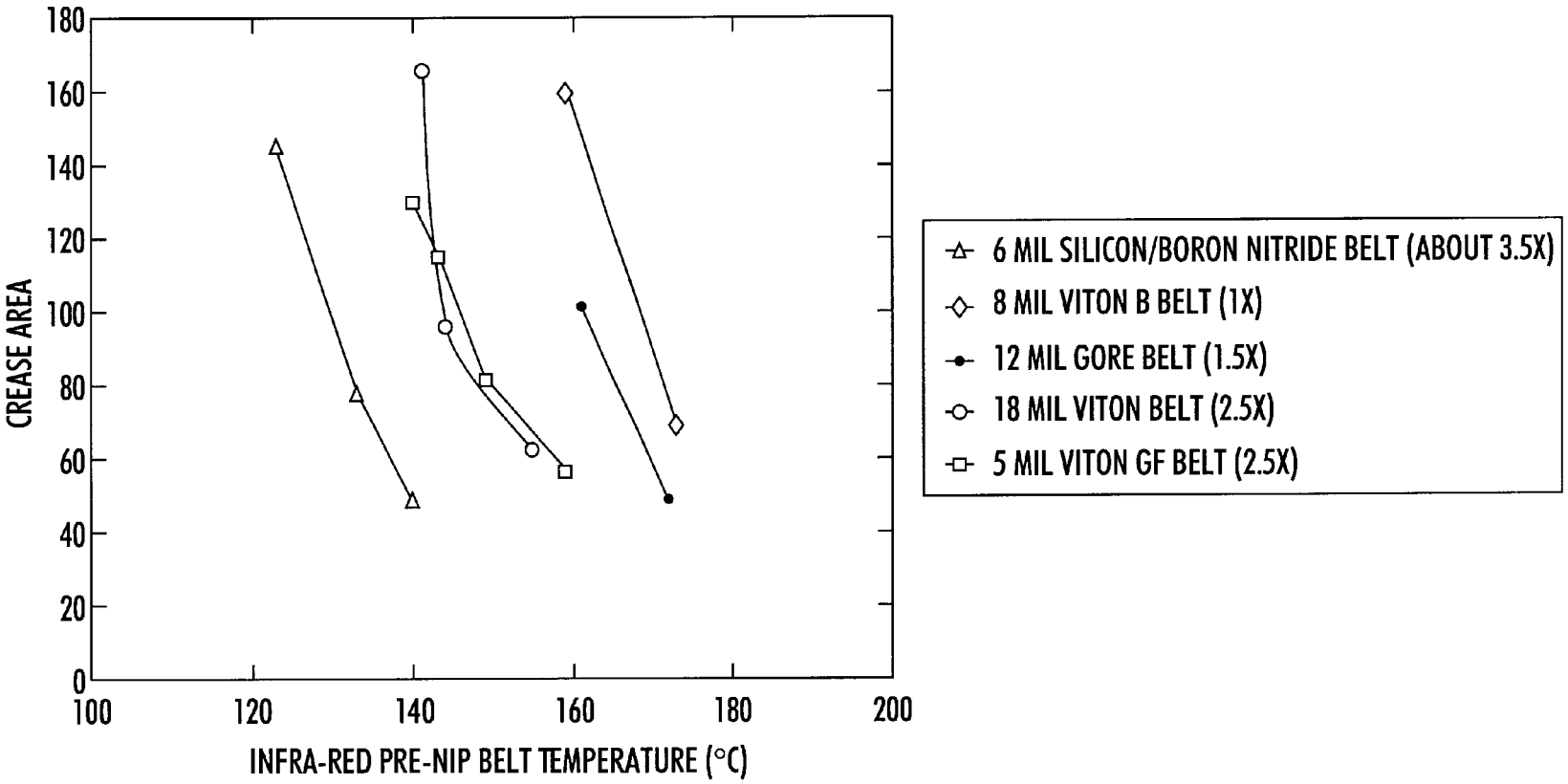
FIG. 2 is a graphical representation of the crease area versus pre-nip belt temperature for the crease area test.
Figure 3:
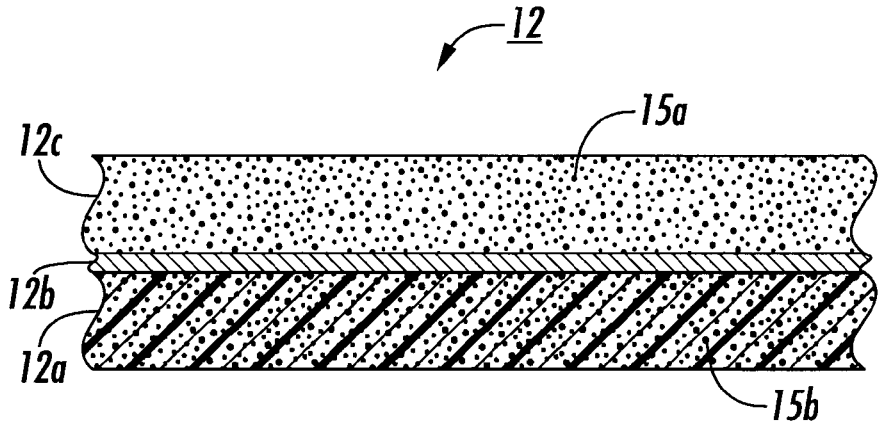
FIG. 3 is a simplified, side elevational view of the fuser member 12 of FIG. 1, wherein fuser member 12 is composed of substrate layer 12*a,* adhesive layer 12*b,* outer toner release layer 12*c,* first thermally conductive additive 15*b,* and second thermally conductive additive 15*a.*

FIG. 2 illustrated an evaluation used to measure the fix of a toner to a sheet of paper and in this context the fix was intended to define the penetration or embedding of toner into the paper. In the test, the crease area was a measure of the fix with the lower the crease area the better the fix. This was a test of fused toner to paper to measure how much of the toner material was flaked or chipped off at any particular point in time and was measured by folding the sheet of paper with a broad band of fixed toner on it and separating it to determine how much toner may be dislodged from the sheet leaving white areas. The poorer the fix of the toner to the paper the larger the white area and the larger the crease number. The crease area test illustrated in FIG. 2 was accomplished with the following parameters: fusing for about 30 milliseconds, 18 inch belts, 2 inch standard nip rollers, and a laboratory fuser fixture.

These five belts were used to evaluate the actual fusing fix performance using the crease method. FIG. 2 summarized the fix levels obtained at a range of belt pre-nip temperatures. The pre-nip temperature decreased as the thermal conductivity k goes from about 1× to about 4×. These examples showed that 2.5× or higher thermally conductive, thin belts would allow at least 20° C. of belt temperature latitude to obtain the same image crease values. In FIG. 2, the fix level must be in the range of about 100 to about 60 crease units (lower is better) to be judged acceptable. The crease area test may be performed using a scanning densitometer or a visual scale with several crease pre-scaled widths.

In other experiments, it was also determined that fusing at longer dwell times in the fusing nip required less heat to achieve the same or similar extent of toner image fixing as compared with shorter dwell times.

Other modifications of the present invention may occur to those skilled in the art based upon a reading of the present disclosure and these modifications are intended to be included within the scope of the present invention.

What is claimed is:

1. A fuser member for use in an electrostatographic printing machine, comprising:

(a) a substrate layer including a base material and a first thermally conductive additive, wherein the base material comprises a plurality of fibers or a polymer film; and (b) an outer toner release layer, which contacts a toner image, including an elastomeric material and a second thermally conductive additive, wherein the fuser member is an endless belt that has a thickness ranging from about 3 to about 20 mils.

2. The fuser member of claim 1, wherein the belt has a thickness ranging from about 5 mils to about 15 mils.

3. The fuser member of claim 1, wherein the toner release layer has a thickness of at least about 3 mils and a hardness ranging from about 45 to about 70 Shore A.

4. The fuser member of claim 1, wherein the first thermally conductive additive is the same as the second thermally conductive additive.

5. The fuser member of claim 1, wherein the first thermally conductive additive and the second thermally conductive additive are independently selected from the group consisting of boron nitride, aluminum oxide, carbon black, aluminum nitride, and zinc oxide.

6. The fuser member of claim 1, wherein the base material is the polymeric film.

7. The fuser member of claim 1, wherein the base material is composed of the plurality of fibers.

8. The fuser member of claim 1, wherein the base material is a polyimide.

9. A fuser system for fixing a toner image onto a medium, comprising:

(a) a fuser member including:

(i) a substrate layer including a base material and a first thermally conductive additive, wherein the base material comprises a plurality of fibers or a polymeric film, and (ii) an outer toner release layer. which contacts the toner image including an elastomeric material and a second thermally conductive additive, wherein the fuser member is an endless belt that has a thickness ranging from about 3 to about 20 mils; and (b) a pressure member adjacent the fuser member wherein the pressure member and the fuser member define therebetween a fusing nip.

* * * * *